United States Patent [19]

Yen

[11] Patent Number: 4,993,330

[45] Date of Patent: Feb. 19, 1991

[54] COMBINED PALLET

[75] Inventor: Neng-Tung Yen, Yung Kang Hsiang, Taiwan

[73] Assignee: Jiun Dean Enterprise Co., Ltd., Tainan Hsien, Taiwan

[21] Appl. No.: 545,057

[22] Filed: Jun. 28, 1990

[51] Int. Cl.[5] ..... B65D 19/12

[52] U.S. Cl. ..... 108/56.1; 108/901; 108/51.1

[58] Field of Search ..... 108/56.1, 51.1, 902, 108/901, 64

[56] References Cited

U.S. PATENT DOCUMENTS

| | | | |
|---|---|---|---|
| 2,857,342 | 12/1958 | Johns et al. | 108/56.1 X |
| 3,277,849 | 10/1966 | Talbot | 108/901 X |
| 3,650,224 | 3/1972 | Petix et al. | 108/56.1 X |
| 3,651,769 | 3/1972 | Foley | 108/56.1 |
| 4,869,179 | 9/1989 | Sammons et al. | 108/56.1 |
| 4,922,834 | 5/1990 | Kraus | 108/51.1 |

*Primary Examiner*—Peter A. Aschenbrenner

*Attorney, Agent, or Firm*—Morton J. Rosenberg; David I. Klein

[57] ABSTRACT

A combined pallet is completed by attaching one after another a plurality of pallet units and an end unit. The pallet unit is molded to form a rectangular board member and at least three attachments arranged in spaced relation below the board member. Each attachment has a substantially cylindrical side wall extending downwardly from bottom surface of the board member to define a chamber, a neck member extending laterally from one side of the socket member and a projection attached to outer end of the neck member. Said pallet units are combined by sequentially mounting socket members of a pallet unit onto corresponding projections and neck member of its following pallet unit and the end unit is then attached to the last pallet unit.

3 Claims, 5 Drawing Sheets

COMBINED PALLET

BACKGROUND OF THE INVENTION

The present invention relates to an improved construction of pallet and mare particularly to a construction of combined pallet.

Pallets constructed of lumber, as shown in FIG. 1, widely used for loading cargos nowaday. Said lumber widely used for loading a plurality of board 51 arranged side by side to define a deck for loading cargo and a plurality of spaced beams 52, which serve as legs of the pallet 5, extending transversely to the boards 51 and secured to underneath surfaces of the boards 51 to define at least two spaced recesses 53 which are provided for lifting a loaded pallet with lift truck forks.

Said lumber pallet resides on the following defects:

(1) It is relatively expensive and heavyweight in construction;

(2) It is moisture absorbent and may thus becoming decaying and heavier in weight after absorbing water or moisture in wet environment;

(3) The sharp or rough edges thereof and fasteners such as nail projecting therefrom can be harmful to workers nearby; and (4) The width of its deck is unchangeable after the pallet being constructed.

SUMMARY OF THE INVENTION

It is therefore a primary object of the present invention to provide an improved combined pallet which diminishes all of the aforementioned disadvantages and defects.

Another object of the present invention is to provide a combined pallet which is durable, warp resistant, moisture resistant and provide substantial strength.

A further object of the present invention is to provide a combined pallet which is inexpensive and lightweight in construction and easy in assembly.

A yet further object of the present invention is to provide a combined pallet which is variable in size.

With the above objective in view, a combined pallet according to the present invention is completed by attaching one after another a plurality of pallet units and an end unit. The pallet unit is molded to form a rectangular board-like member and at least three attachments arranged in spaced relation below the board-like member. Each of the attachments has a substantially cylindrical side wall extending downwardly from bottom surface of the board-like member to define a chamber, a neck member extending laterally from one side of the socket member and a projection attached to outer end of the neck member. Said pallet units are combined by sequentially mounting socket members of a pallet unit onto corresponding projections and neck member of its following pallet unit and the end unit is then attached to the last assembled pallet unit to complete the combining operation of the pallet.

DETAILED DESCRIPTION OF THE PREFERRED EMBODIMENT

Figure 1:
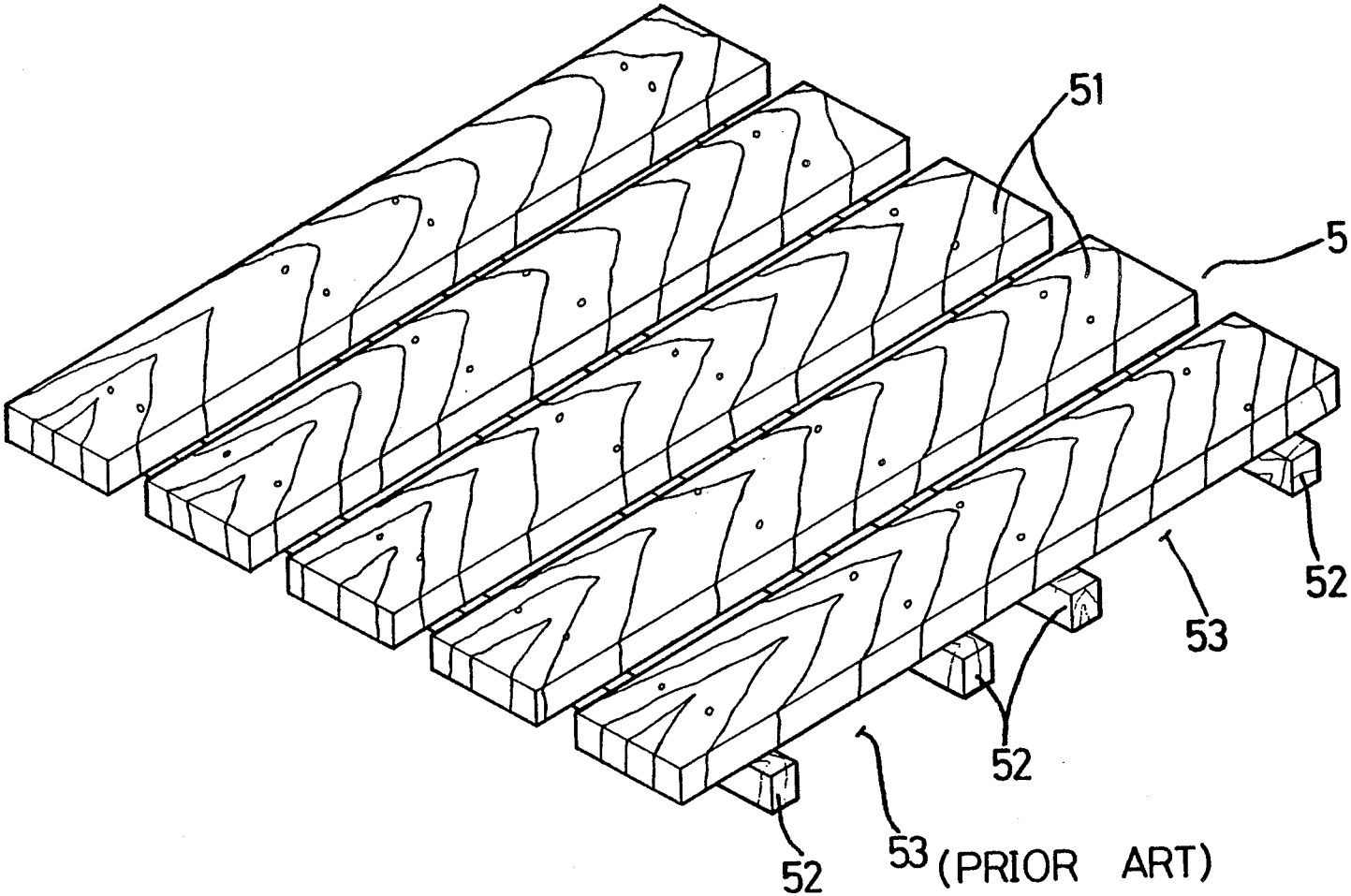
FIG. 1 (PRIOR ART)
FIG. 1 is a perspective view of a known lumber pallet.
Figure 2:
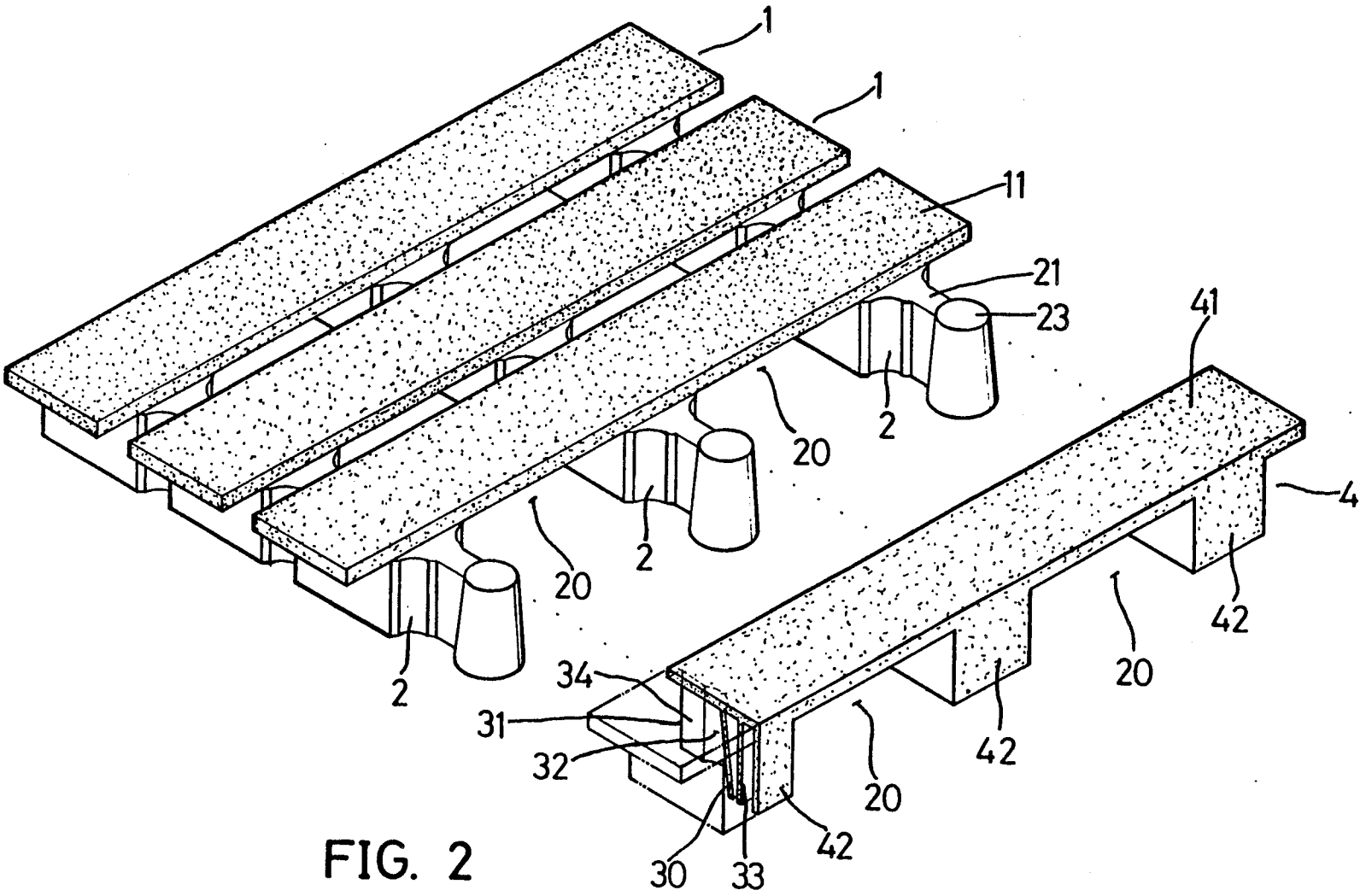
FIG. 2 is a perspective view of a combined pallet constructed in accordance with the invention and an end unit in its disassembled state.
Figure 3:
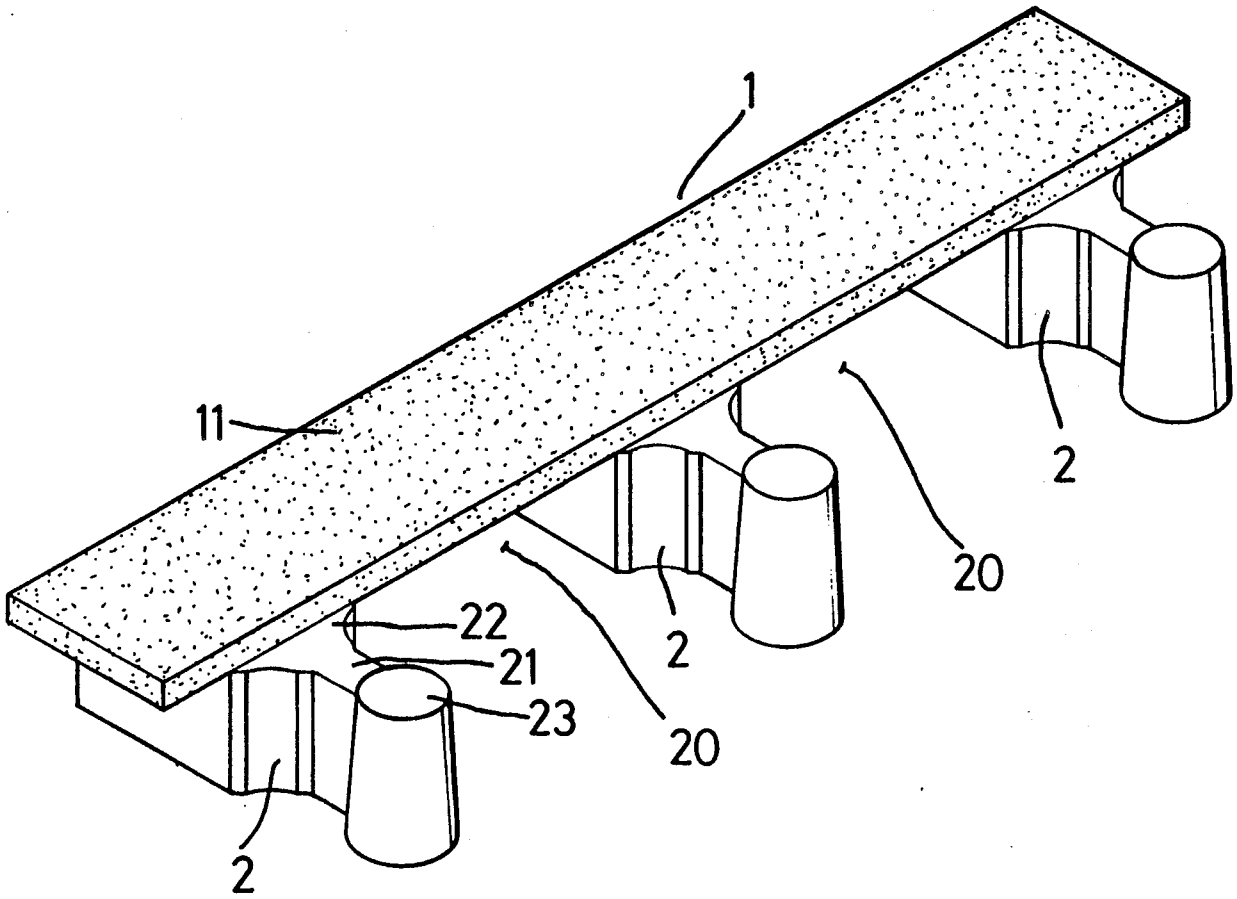
FIG. 3 is a perspective view of an unit to be used for being combined to form a pallet shown in FIG. 2.
Figure 4:
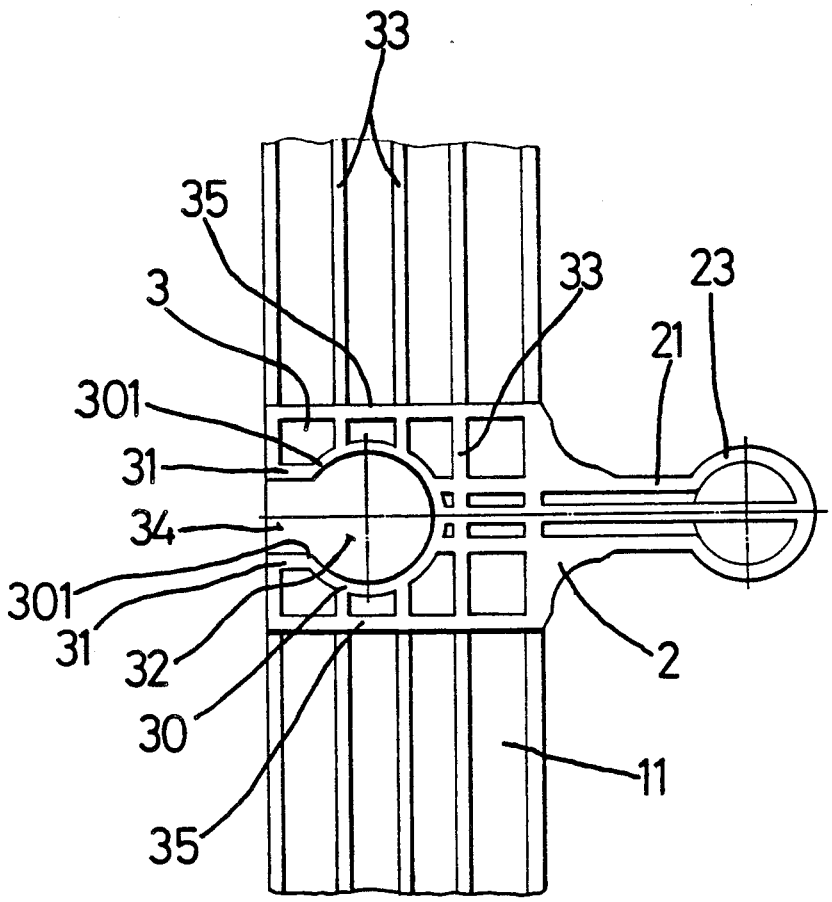
FIG. 4 is a bottom view of a fragment of the unit shown in FIG. 3.
Figure 5:
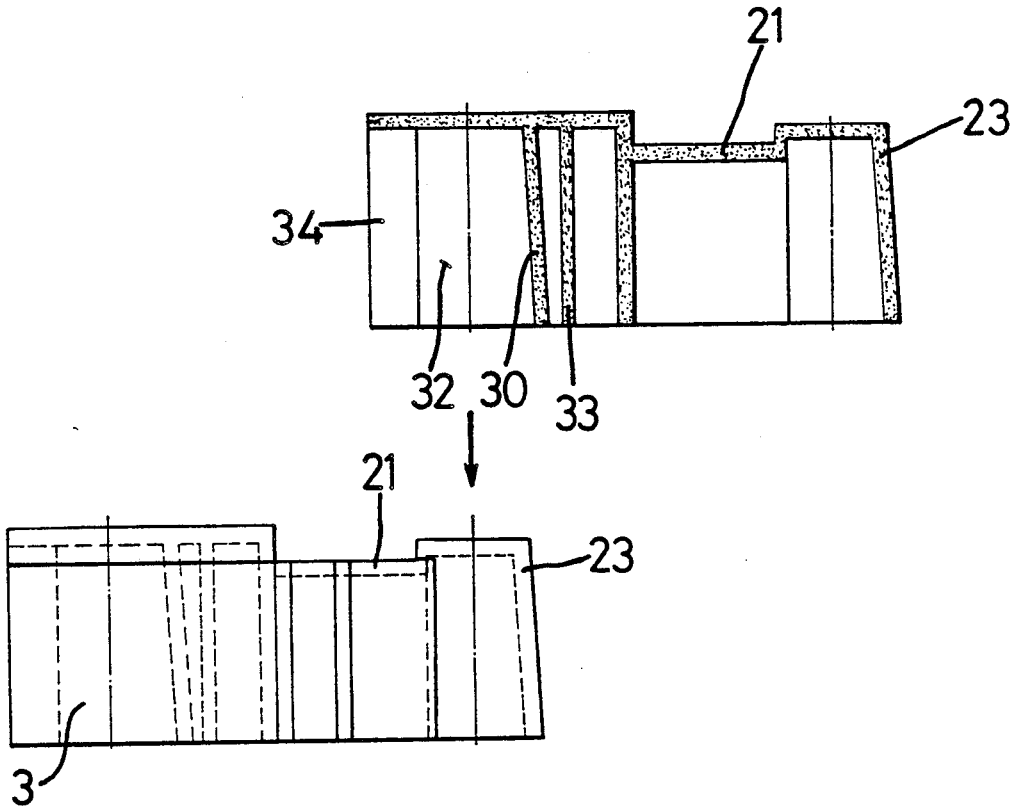
FIG. 5 is a diagrammatically side view showing an attaching operation of two adjacent pallet units.

Referring to FIG. 2, a plurality of pallet units 1 and an end unit 4 both molded integrally from a plastic material are combined to form a complete pallet of the present invention. The pallet unit 1, as best shown in FIG. 3, includes a board-like member 11 and three attachments 2 serving as legs of the pallet unit 1 arranged at equal intervals below the board-like member 11 to define two spaced recesses 20. The attachment 2, as best shown in FIGS. 4 and 5, is integrally formed with a socket 3, a truncated cone-shaped projection 23 and a neck 21 interconnecting the socket 3 and projection 23.

The socket 3 includes a pair of opposed side walls 35 extending transversely across width of the board 11 and, within the side walls 35, a substantially cylindrical side wall 30 and a pair of opposed side wall 31 connecting respectively the ends 301 of the cylindrical side walls 30 coacting to define cavities 32, 34 conforming respectively shapes of the projection 23 and a portion, which connects the projection 23, of the neck 21. Said side walls 35, 30, 31 and a plurality of ribs 33, which extend longitudinally through the length of the board-like member 11. for reinforcing the board-like member 11, extend downwardly from bottom surface of the board-like member 11. The neck 21 and the projection 23 extend laterally and outwardly from one side of the board-like member 11.

The neck 21 extends upwardly to approximately the height of the bottom of the board-like member 11 and the projection 23 extends upwardly to the top level of the cavity 32 defined by the cylindrical side wall 30. The end unit 4 is similar in construction to the pallet unit 1 except that the end unit 4 has no offsetting neck and projection. Said end unit 4 includes a board-like member 41 same in dimension of the board-like member 11 of the pallet unit 1, and three socket legs 42 integrally formed under the board-like members at equal intervals to define two spaced recesses 20 with front sides thereof terminated with respective vertical side walls. Within each legs 42, there is formed a plurality of parallel ribs 33 for reinforcing the board member 41 and substantially cylindrical side walls 30 and opposed side walls 34 attached to open ends of the cylindrical side wall 30 to define cavities 32, 34 for engaging the projection 23 and neck 21 of adjacent pallet unit 1.

In operation, a proper amount of pallet units 1 and an end unit 4 are sequentially attached one after another by mounting sockets 3 of the pallet unit 1 or end unit 4 onto corresponding projections 23 of its adjacent pallet unit 1 to complete a pallet. The pallet thus constructed has a deck of desired width and flat surface for loading cargo and two longitudinally spaced recesses 20 respectively formed between opposed attachments 2 which alligned in rows.

While the invention has been described with what is presently considered to be the most practical and preferred embodiment, it is to be understood that the invention is not the be limited to the disclosed embodiment, but on the contrary, is intended to cover various modifications and equivalent arrangements.

What is claimed is:

1. A combined pallet comprising:

a plurality of pallet units and an end unit attached one after another to form a pallet of desired width, each of said pallet units including:

a molded rectangular board member; and at least three attachments arranged in spaced relation below said board member and each being formed with a socket member having a substantially cylindrical side wall extending downwardly from a bottom portion of said board member and defining a chamber, a neck member extending laterally from one side of the cylindrical side wall of the socket member and in a direction transverse to longitudinal direction of the board member and a projection attached to outer end of the neck member, said chamber being conformed to the projection and at least a portion of the neck member attaching the projection;

said end unit including:

a molded rectangular board member same in dimension as board members of the pallet units; and at least three attachments arranged in spaced relation under the board member of the end unit and each attachment being formed with a socket member having a substantially cylindrical side wall extending downwardly from a bottom surface of the board member of the end unit and defining a chamber being conformed to the projection and at least a portion of the neck member attaching the projection of the pallet unit.

2. A combined pallet as claimed in claim 1 wherein the board member and the attachments below the board member of the pallet unit are integrally molded from a plastic material.

3. A combined pallet as claimed in claim 1 wherein the board member and the attachments below the board member of the end unit are integrally molded from a plastic material.

* * * * *